US010902985B2

(12) United States Patent
Ogasawara

(10) Patent No.: US 10,902,985 B2
(45) Date of Patent: Jan. 26, 2021

(54) ELECTROMAGNETIC ACTUATOR

(71) Applicant: MIKUNI CORPORATION, Tokyo (JP)

(72) Inventor: Toshiki Ogasawara, Takizawa (JP)

(73) Assignee: MIKUNI CORPORATION, Tokyo (JP)

( * ) Notice: Subject to any disclaimer, the term of this patent is extended or adjusted under 35 U.S.C. 154(b) by 80 days.

(21) Appl. No.: 15/955,184

(22) Filed: Apr. 17, 2018

(65) Prior Publication Data

US 2018/0315533 A1 Nov. 1, 2018

(30) Foreign Application Priority Data

Apr. 27, 2017 (JP) ..... 2017-088470

(51) Int. Cl.

| | |
|---|---|
| ***H01F 7/00*** | (2006.01) |
| ***H01F 7/16*** | (2006.01) |
| ***H01F 7/08*** | (2006.01) |
| *H01F 7/128* | (2006.01) |

(52) U.S. Cl.

CPC ..... *H01F 7/1646* (2013.01); *H01F 7/081* (2013.01); *H01F 7/128* (2013.01); *H01F 2007/086* (2013.01)

(58) Field of Classification Search

CPC ..... H01F 7/081
USPC ..... 335/220, 229
See application file for complete search history.

(56) References Cited

U.S. PATENT DOCUMENTS 6,313,726 B1 * 11/2001 Golovatai-Schmidt ..... H01F 7/17 251/129.09
6,373,363 B1 * 4/2002 Spakowski ..... F02M 51/0614 251/129.15
6,646,529 B1 * 11/2003 Kahnert ..... H01H 71/322 335/229
6,967,550 B2 * 11/2005 Elendt ..... F01L 13/0036 123/90.11

(Continued)

FOREIGN PATENT DOCUMENTS

| | | |
|---|---|---|
| JP | 5-29133 | 2/1993 |
| JP | 6-77046 | 3/1994 |

(Continued)

OTHER PUBLICATIONS

Office Action, dated Nov. 25, 2020, in Japanese Application No. 2017-088470 (8 pp.).

*Primary Examiner* — Alexander Talpalatski

(57) ABSTRACT

An electromagnetic actuator in which magnetic force from a permanent magnet causes a stator core and a first plunger to attract each other, and electromagnetic force generated by energizing an electromagnetic coil causes a mover to resist against the magnetic force from the permanent magnet to move in an axial direction separating from a front end portion of the stator core, wherein a ring member provided on the mover is inserted in the axial direction into a hole portion provided in a bottom wall member of a yoke, and an overlap size between the ring member and the bottom wall member is increased when the mover moves relative to the stator core in a separating direction, so that a magnetism transmission quantity from the permanent magnet passing through an overlap portion between the ring member and the bottom wall member is inhibited from being reduced.

4 Claims, 6 Drawing Sheets

(56) References Cited

U.S. PATENT DOCUMENTS

| | | | | |
|---|---|---|---|---|
| 7,075,398 | B2 * | 7/2006 | Morita | H01F 7/1615 335/220 |
| 8,081,053 | B2 * | 12/2011 | Yamagata | H01F 7/081 251/129.15 |
| 8,193,887 | B2 * | 6/2012 | Sohn | H01F 3/02 335/299 |
| 8,203,405 | B2 * | 6/2012 | Golz | F01L 13/0036 335/229 |
| 8,493,166 | B2 * | 7/2013 | Golz | B23F 1/02 335/229 |
| 9,702,278 | B2 * | 7/2017 | Gruener | F01L 13/0036 |
| 2006/0017535 | A1 * | 1/2006 | Nagasaki | H01F 7/13 335/220 |
| 2013/0147583 | A1 * | 6/2013 | Schiepp | F01L 1/46 335/229 |

FOREIGN PATENT DOCUMENTS

| | | |
|---|---|---|
| JP | 11-210430 | 8/1999 |
| JP | 2017-45950 | 3/2017 |

* cited by examiner

ELECTROMAGNETIC ACTUATOR

CROSS REFERENCE TO RELATED APPLICATIONS

This application is based upon and claims the benefit of priority of the prior Japanese Patent Application No. 2017-088470, filed on Apr. 27, 2017, the entire contents of which are incorporated herein by reference.

BACKGROUND OF THE INVENTION

Field of the Invention

The present invention relates to an electromagnetic actuator, particularly to a latching electromagnetic actuator, which causes a mover to straightly move using electromagnetic force.

Description of the Related Art

An electromagnetic actuator used in an electromagnetic valve, an internal combustion engine, and the like includes, for example, a stator formed by winding a coil around a stator core, and a mover formed of magnetic substance, as described in Japanese Patent Laid-Open No. 5-29133, and is configured to move the mover relative to the stator using magnetic force generated by energizing the coil.

In particular, the above Literature discloses a latching electromagnetic actuator including a permanent magnet as the mover and being able to latch itself by using magnetic force of the permanent magnet to let the mover and the stator attract each other, while being configured to cause the mover and the stator to repel each other to cause the mover to straightly move from the stator in a separating direction by energizing the coil.

The electromagnetic actuator described in the above Literature includes a yoke formed in a cylindrical shape to which the stator core and the coil are fixed and in which the mover is housed. The yoke is formed of magnetic substance and configured to let lines of magnetic force from the permanent magnet and lines of magnetic force generated by energizing the coil to pass therethrough.

In an electromagnetic actuator having a configuration as in the above Literature, when a coil is energized to move a mover in a separating direction from a latched position where the coil is not energized, and a stator and the mover attract each other, electromagnetic force exerted by the coil is used to cause the mover to repel against magnetic force exerted by a permanent magnet. Therefore, to improve responsiveness of the electromagnetic actuator, it is desirable in the latched position that the magnetic force exerted by the permanent magnet is made as weak as possible insofar as the latch requires.

However, if the magnetic force of the permanent magnet is set to be weak, when the energization of the coil is stopped where the energization of the coil makes a distance between the stator and the mover long, the mover cannot be attracted sufficiently, which may lead to malfunction of the mover.

SUMMARY OF THE INVENTION

The present invention is made in view of such a problem and has an objective to provide a latching electromagnetic actuator with high responsiveness.

To achieve the above objective, an electromagnetic actuator according to the present invention includes: a stator including a yoke with a housing space, a stator core provided in the housing space, and an electromagnetic coil disposed surrounding the stator core; and a mover including a permanent magnet and provided movably relative to the stator core in the housing space in an axial direction of the yoke, wherein magnetic force from the permanent magnet causes the stator core and the mover to attract each other, and electromagnetic force generated by energizing the electromagnetic coil causes the mover to resist the magnetic force from the permanent magnet to move from the stator core in a separating direction, and wherein the electromagnetic actuator further comprises a magnetism transmission quantity adjusting portion provided at a position through which lines of magnetic force from the permanent magnet pass and configured to increase a magnetism transmission quantity from the permanent magnet when the mover moves relative to the stator core in the separating direction.

When the mover is caused to move from the stator core in the separating direction, the electromagnetic actuator according to the present invention acts so that reduction in attraction due to separation of the mover and the stator core is offset. It is therefore possible to set the electromagnetic actuator such that, at a position where the mover and the stator core attract each other, attraction is reduced, while a large attraction by the magnetic force from the permanent magnet can be ensured at a position where the mover is caused to move from the stator core in the separating direction. This allows the electromagnetic actuator to be highly responsive when an electromagnetic coil is energized to move the mover, with movement of the mover toward a stator core side by the magnetic force from the permanent magnet in stopping energization of the electromagnetic coil ensured.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION OF THE INVENTION

Hereinafter, embodiments of the present invention will be described with reference to the accompanying drawings.

First, an electromagnetic actuator 1 in a first embodiment of the present invention will be described with reference to FIGS. 1 to 6.

Figure 1:
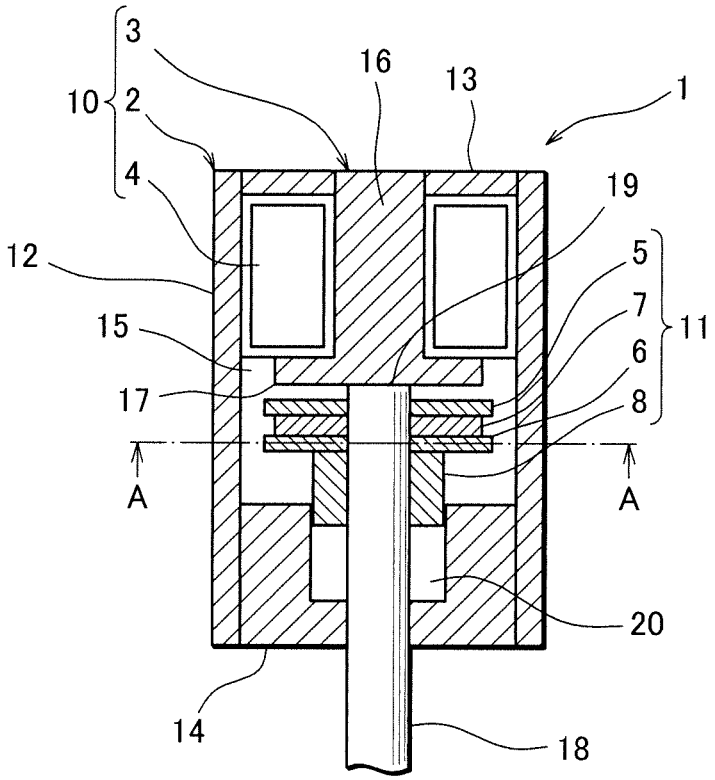
FIG. 1 is a longitudinal sectional view illustrating a structure of an electromagnetic actuator in a first embodiment of the present invention.
Figure 2:
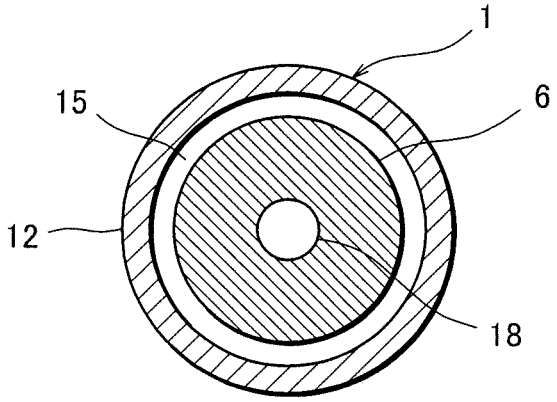
FIG. 2 is a transverse sectional view of the electromagnetic actuator in the first embodiment.

FIG. 1 is a longitudinal sectional view illustrating a structure of an electromagnetic actuator 1 in the first embodiment of the present invention. FIG. 2 is a transverse sectional view of the electromagnetic actuator 1 in the first embodiment, illustrating a cross section at a portion A-A illustrated in FIG. 1.

The electromagnetic actuator 1 in the first embodiment of the present invention is a latching electromagnetic actuator used in, for example, an electromagnetic valve and a valve mechanism of an internal combustion engine.

As illustrated in FIGS. 1, 2, the electromagnetic actuator 1 in the first embodiment includes a stator 10 and a mover 11, the stator 10 having a yoke 2, a stator core 3 and an electromagnetic coil 4, the mover 11 having two plungers 5, 6, a permanent magnet 7 and a ring member 8. The yoke 2, stator core 3, plungers 5, 6 and ring member 8 are formed of magnetic material such as iron.

The yoke 2 is formed by blocking both ends of a cylindrical surrounding wall member 12 with a top wall member 13 and a bottom wall member 14. At a center of the top wall member 13 having an annular disk shape and blocking one end portion of the yoke 2, namely an upper-end portion in FIG. 1, the stator core 3 having a columnar shape is fixed on an internal space 15 side of the yoke 2 in such a manner that the stator core 3 protrudes in an axial direction of the yoke 2. Around an axial portion 16 of the stator core 3, the electromagnetic coil 4 is wound. The stator core 3 includes a front end portion 17 formed to have a disk shape whose diameter is made larger than that of the axial portion 16. The bottom wall member 14 of the yoke 2 corresponds to an edge member according to the present invention, and the internal space 15 corresponds to a housing space according to the present invention.

Through a center of the bottom wall member 14 blocking another end portion of the yoke 2, namely a bottom end portion in FIG. 1, a shaft 18 movably penetrates in the axial direction. The shaft 18 is formed of non-magnetic material.

The two plungers including a first plunger 5 and a second plunger 6, and the permanent magnet 7 are formed in disk shapes having diameters substantially the same as that of the front end portion 17 of the stator core 3, and are disposed in such a manner that the first plunger 5 and the second plunger 6 sandwiches the permanent magnet 7. The first plunger 5 and the second plunger 6 are coaxially fixed to a front end portion 19 of the shaft 18 laying in the internal space 15 of the yoke 2, and the first plunger 5 is disposed facing the front end portion 17 of the stator core 3.

The mover 11 is allowed to move straightly in the axial direction together with the shaft 18 in the internal space 15 of the yoke 2. As a result, the movement of the mover 11 changes a distance between the front end portion 17 of the stator core 3 and the first plunger 5 facing the front end portion 17. As illustrated in FIG. 1, the front end portion 19 of the shaft 18 slightly protrudes from a top face of the first plunger 5 so that a small gap is provided between the front end portion 17 of the stator core 3 and the first plunger 5 when the front end portion 19 of the shaft 18 comes into contact with the front end portion 17 of the stator core 3.

The electromagnetic actuator 1 in the first embodiment further includes the ring member 8 coaxially, tightly provided on a bottom face of the second plunger 6, namely, on an opposite face to the permanent magnet 7, the ring member 8 having a columnar shape. An outer diameter of the ring member 8 is smaller than an outer diameter of the second plunger 6.

In a center portion of the bottom wall member 14 of the yoke 2, a hole portion 20 is formed extending in the axial direction of the yoke 2, the hole portion 20 allowing the ring member 8 to be inserted therethrough. An axial-direction dimension of the ring member 8 is set such that allows the bottom end portion of the ring member 8 to be slightly inserted through the hole portion 20 in the bottom wall member 14 of the yoke 2 when the front end portion 19 of the shaft 18 comes into contact with the front end portion 17 of the stator core 3.

The ring member 8 and the hole portion 20 of the bottom wall member 14 correspond to a magnetism transmission quantity adjusting portion according to the present invention.

Figure 3:
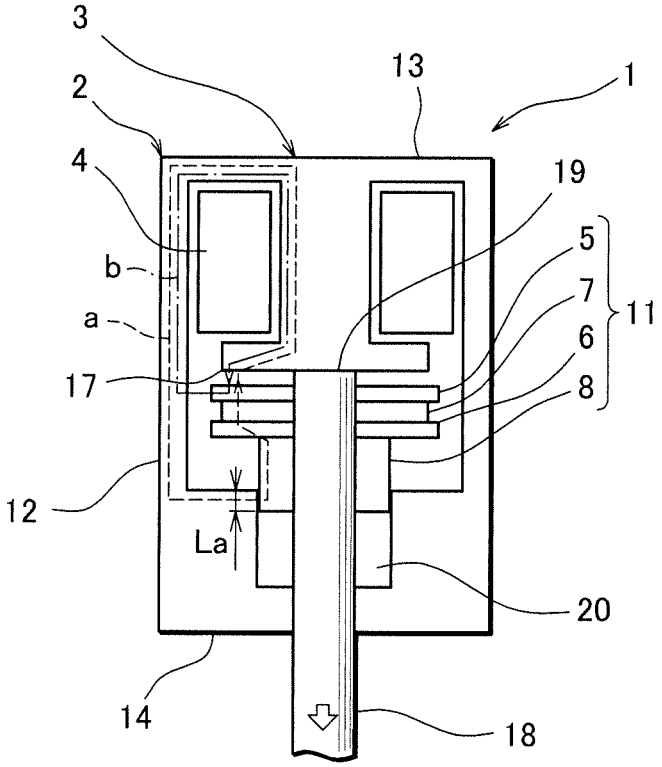
FIG. 3 is a longitudinal sectional view illustrating the electromagnetic actuator functioning in a latched position in the first embodiment.
Figure 4:
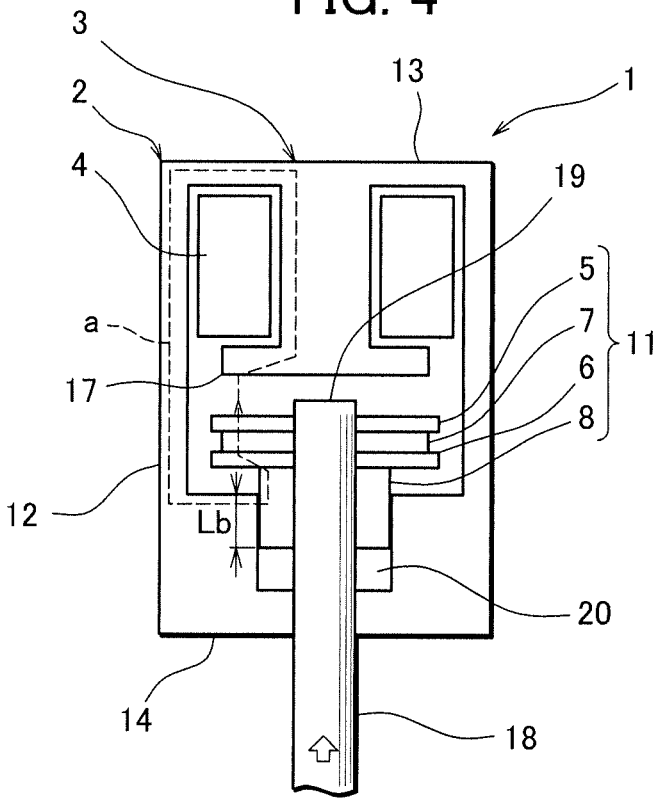
FIG. 4 is a longitudinal sectional view illustrating the electromagnetic actuator functioning in a stroke midway position in the first embodiment.

FIGS. 3, 4 are longitudinal sectional views of the electromagnetic actuator 1 in the first embodiment, FIG. 3 illustrates the electromagnetic actuator 1 functioning in a latched position S0, and FIG. 4 illustrates the electromagnetic actuator 1 functioning in a stroke midway position S1. In FIG. 3 and FIG. 4, and in FIGS. 5, 9, and 12 to be described later, broken lines each represent main lines of magnetic force a from the permanent magnet 7, and dash-dot lines each represent main lines of magnetic force b from the electromagnetic coil 4.

A stroke S refers to a distance of straight movement made by the mover 11 in the axial direction and indicates a movement position of the mover 11. The stroke S is set as S=0 in the latched position S0 where the front end portion 19 of the shaft 18 is in contact with the front end portion 17 of the stator core 3, and the stroke S increases as the mover 11 moves in a direction of being separated from the front end portion 19 of the shaft 18, namely downward in FIGS. 3, 4. The stroke midway position S1 is a position between the latched position S0 and a stroke maximum position Smax up to which the mover 11 can move at most in the separating direction.

In the electromagnetic actuator 1 in the first embodiment configured in the above manner, when the electromagnetic coil 4 is not energized, a magnetic force Fa exerted by the permanent magnet 7 causes the stator core 3 and the mover 11 to attract each other as illustrated in FIG. 3, so that the front end portion 19 of the shaft 18 is latched butting against the front end portion 17 of the stator core 3.

In the latched position S0 where the front end portion 19 of the shaft 18 is in contact with the front end portion 17 of the stator core 3 in this manner, the main lines of magnetic force a from the permanent magnet 7 pass through the permanent magnet 7, first plunger 5, stator core 3, top wall member 13 of the yoke 2, surrounding wall member 12, bottom wall member 14, ring member 8, and second plunger 6 in order, and returns to the permanent magnet 7.

At this point, the bottom wall member 14 of the yoke 2 and the ring member 8 overlap each other in the axial direction illustrated in FIG. 4 by an overlap size La along an overall circumference, and the lines of magnetic force a pass through this overlap region. This region where the bottom wall member 14 of the yoke 2 and an outer circumferential surface of the ring member 8 overlap each other in the axial direction is a region which has a smallest cross-sectional area of regions through which the lines of magnetic force a from the permanent magnet 7 pass.

Now, when the electromagnetic coil 4 is here energized to cause the shaft 18 to move in the separating direction, the lines of magnetic force b from the electromagnetic coil 4 pass through the stator core 3, first plunger 5, surrounding wall member 12 of the yoke 2, and top wall member 13 in order, and returns to the stator core 3.

Therefore, when the electromagnetic coil 4 is energized in the latched position, an electromagnetic force Fb generated by the electromagnetic coil 4 causes the mover 11 to resist the attraction between the stator core 3 and the mover 11 exerted by the magnetic force Fa from the permanent magnet 7, so that the mover 11 repels the stator core 3 to move separating in the axial direction.

As illustrated in FIG. 4, when the mover 11 moves from the latched position in the separating direction, the bottom end portion of the ring member 8 moves entering the hole portion 20 in the bottom wall member 14 of the yoke 2. Therefore, an overlap size Lb between the bottom wall member 14 and the ring member 8, which is an insertion distance of the ring member 8 with respect to the hole portion 20, is larger than the overlap size La in the latched position S0 illustrated in FIG. 3. The movement of the mover 11 from the latched position S0 in the separating direction therefore allows passage of more lines of magnetic force a from the permanent magnet 7 to pass than in the latched position S0, which works to increase a magnetism transmission quantity between the ring member 8 and the bottom wall member 14 of the yoke 2 from the permanent magnet 7. Actually, when the mover 11 moves from the latched position S0 in the separating direction, the magnetism transmission quantity from the permanent magnet 7 is reduced due to the separation between the stator core 3 and the first plunger 5, but the present embodiment acts to offset this reduction of the magnetism transmission quantity.

In this manner, in the first embodiment, the overlap size La between the bottom wall member 14 of the yoke 2 and the ring member 8 is made small in the latched position S0 to suppress the magnetic force Fa from the permanent magnet 7. In this state, as the mover 11 is caused to move from the latched position S0 in the separating direction, the overlap size Lb increases, so that an area through which the lines of magnetic force a from the permanent magnet 7 can pass increases, which offsets the reduction of the magnetic force Fa from the permanent magnet 7 due to the separation between the stator core 3 and the first plunger 5, ensuring the attraction between the stator core 3 and the mover 11.

Next, using the electromagnetic actuator 1 in the first embodiment having the above configuration and a conventional electromagnetic actuator 30 in a reference embodiment without the ring member 8, comparison is made between the magnetic force Fa and magnetic force Fc from the permanent magnet 7 disposed in the mover 11.

Figure 5:
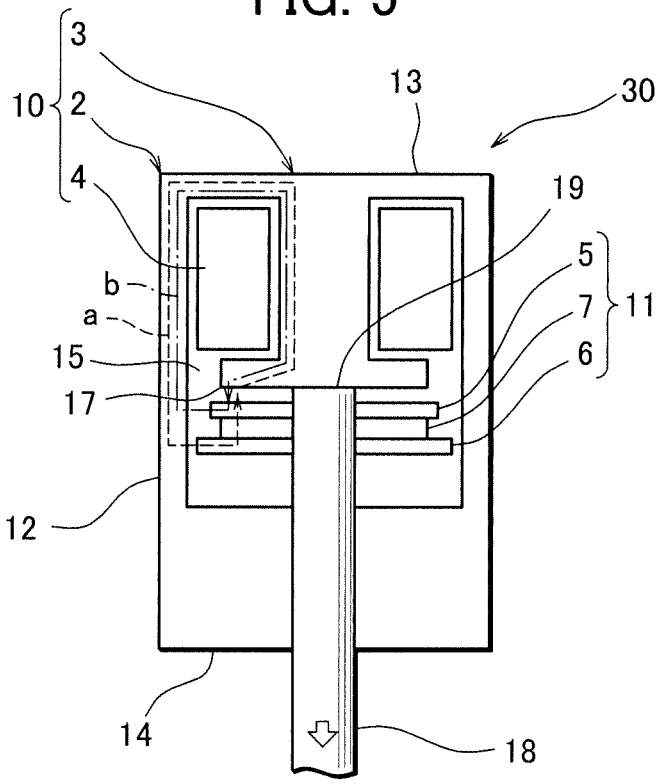
FIG. 5 is a longitudinal sectional view illustrating a structure of an electromagnetic actuator in a reference embodiment.
Figure 6:
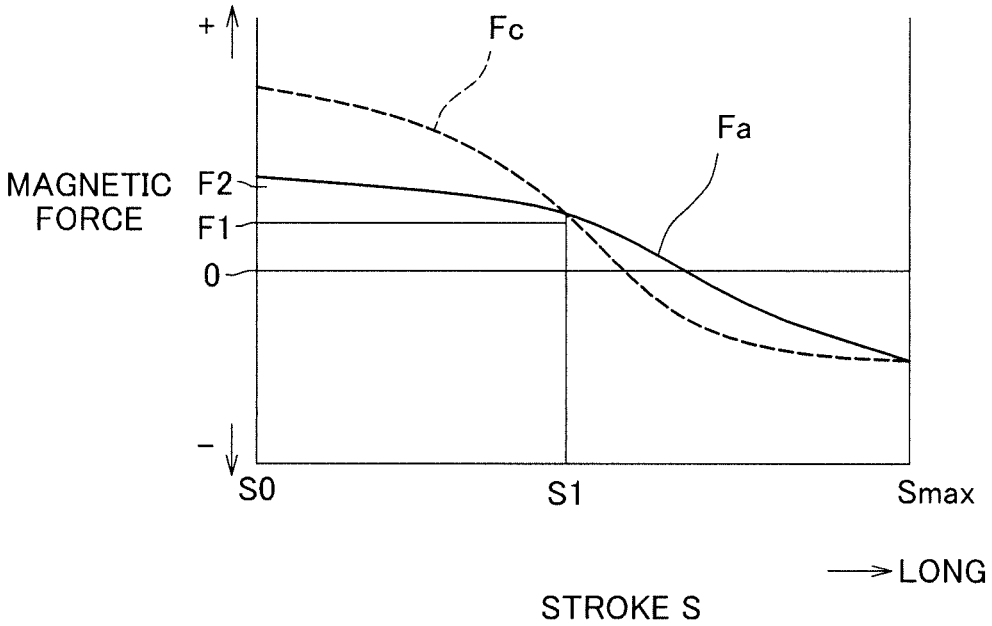
FIG. 6 is a graph illustrating comparison of how magnetic forces exerted by a permanent magnet change with respect to a stroke between the first embodiment and the reference embodiment.

FIG. 5 is a longitudinal sectional view illustrating a structure of an electromagnetic actuator 30 in the reference embodiment. FIG. 6 is a graph illustrating comparison of how the magnetic forces Fa, Fc exerted by the permanent magnet 7 change with respect to the stroke S between the first embodiment and the reference embodiment.

It is noted in FIG. 6 that a sign + denotes a direction in which the magnetic forces Fa, Fc act as attractions between the stator core 3 and the mover 11, and a sign—denotes a direction in which the magnetic forces Fa, Fc act to separate the mover 11 from the stator core 3.

As illustrated in FIG. 5, the electromagnetic actuator 30 in the reference embodiment differs from the electromagnetic actuator 1 in the first embodiment in not including the ring member 8. In addition, not including the ring member 8 dispenses with the hole portion 20 in the bottom wall member 14 of the yoke 2.

In the electromagnetic actuator 30 in the reference embodiment, as illustrated in FIG. 5, the main lines of magnetic force a from the permanent magnet 7 pass from the permanent magnet 7 through the first plunger 5, stator core 3, top wall member 13 of the yoke 2, surrounding wall member 12, and second plunger 6 in order, and returns to the permanent magnet 7.

Therefore, as illustrated by the broken line in FIG. 6, the magnetic force Fc from the permanent magnet 7 in the electromagnetic actuator 30 in the reference embodiment considerably reduces as the stroke S increases, that is, as the distance between the front end portion 17 of the stator core 3 and the first plunger 5 increases.

In contrast, in the electromagnetic actuator 1 in the first embodiment, although the magnetic force Fa from the permanent magnet 7 reduces as the distance between the front end portion 17 of the stator core 3 and the first plunger 5 considerably increases as in the above reference embodiment, the overlap size La between the bottom wall member 14 of the yoke 2 and the outer circumferential surface of the ring member 8 in the axial direction increases as the stroke S increases as described above, so that a passage area of the lines of magnetic force a increases, offsetting the reduction in the magnetic force Fa.

As a result, by setting the magnetic force Fa in the electromagnetic actuator 1 in the first embodiment and the magnetic force Fc in the electromagnetic actuator 30 in the reference embodiment to match in the predetermined stroke midway position S1, the magnetic force Fa in the first embodiment can be more significantly reduced than in the reference embodiment in the latched position S0 where the stroke S=0, with the magnetic force Fa in the first embodiment set to be larger than the magnetic force Fc in the reference embodiment in the stroke maximum position Smax.

In the electromagnetic actuator 1 in the first embodiment, the magnetic force Fa of the permanent magnet 7 assumes—in a vicinity of the stroke maximum position Smax. This is because the magnetic force from the permanent magnet 7 increases attraction between the second plunger 6 and the bottom wall member 14. The mover 11 is then latched butting against the bottom wall member 14 in the stroke maximum position Smax. The electromagnetic actuator 1 is used in a system having a configuration using attraction provided by the magnetic force Fa from the permanent magnet 7 as well as a mechanical arrangement, to urge the mover 11 in an attracting direction toward a stator core 3 side, namely a direction in which the stroke S is decreased, between the stroke midway position S1 and the stroke maximum position Smax.

Therefore, in a case where the electromagnetic actuator 1 is used in such a system, by setting attraction toward the stator core 3 side exerted by the permanent magnet 7 at an necessary attraction F1 or stronger in the stroke midway position S1, movement from the stroke midway position S1 to the latched position S0 can be ensured, and the electromagnetic actuator 1 can function with high responsiveness.

In addition, in the stroke maximum position Smax, the second plunger 6 or the ring member 8 butts against or approaches the bottom wall member 14 of the yoke 2, so that the attraction between the second plunger 6 and the bottom wall member 14 exerted by the magnetic force from the permanent magnet 7 can ensure latching force acting on the mover 11 in the stroke maximum position Smax to the same extent as in the reference embodiment.

In contrast, in the latched position S0, the attraction exerted by the permanent magnet 7 can be reduced to a value closer to a necessary latching force F2 than in the reference embodiment. This allows the shaft 18 to be moved in a protruding direction with high responsiveness when the electromagnetic coil 4 is energized in the latched position S0 where the electromagnetic coil 4 is not energized.

As seen from the above, the electromagnetic actuator 1 in the first embodiment is a latching electromagnetic actuator configured to latch the mover 11 by the permanent magnet 7 when the electromagnetic coil 4 is not energized, and to cause the mover 11 to resist the magnetic force Fa exerted by the permanent magnet 7 to straightly move in the separating direction when the electromagnetic coil 4 is energized, wherein the attraction between the stator core 3 and the mover 11 exerted by the permanent magnet 7 is ensured in the stroke midway position S1 when the electromagnetic coil 4 is brought from an energized state into a non-energized state, and with the attraction between the bottom wall member 14 of the yoke 2 and the mover 11 exerted by the permanent magnet 7 ensured also in the stroke maximum position Smax, the latching force exerted by the permanent magnet 7 can be reduced to a minimum as far as is not weaker than the necessary latching force F2 in the latched position S0 where the electromagnetic coil 4 is not energized, so that the electromagnetic actuator can be made highly responsive in the latched position S0 and the stroke midway position S1.

Next, an electromagnetic actuator 40 in a second embodiment of the present invention will be described with reference to FIGS. 7 to 10.

Figure 7:
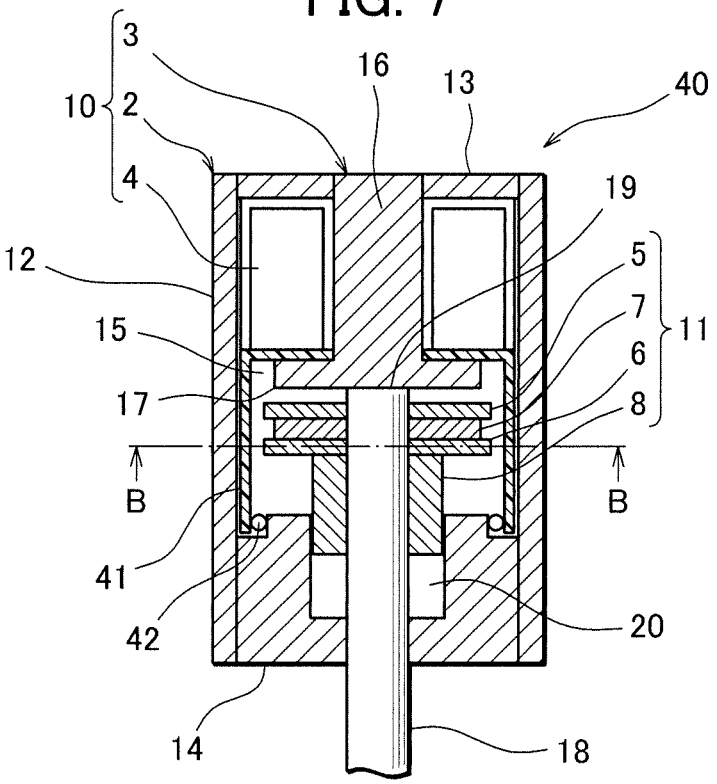
FIG. 7 is a longitudinal sectional view illustrating a structure of an electromagnetic actuator in a second embodiment of the present invention.
Figure 8:
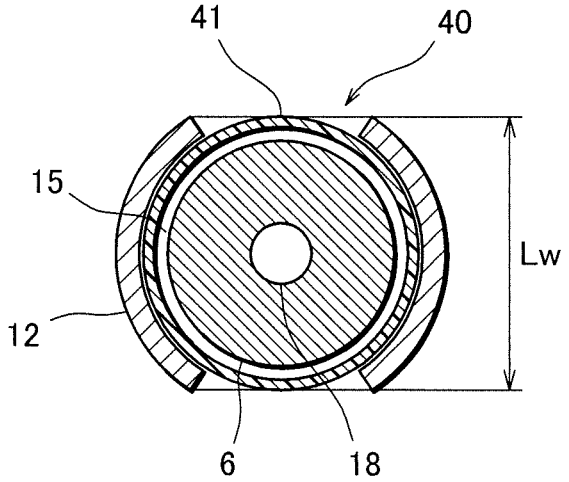
FIG. 8 is a transverse sectional view of the electromagnetic actuator in the second embodiment.
Figure 9:
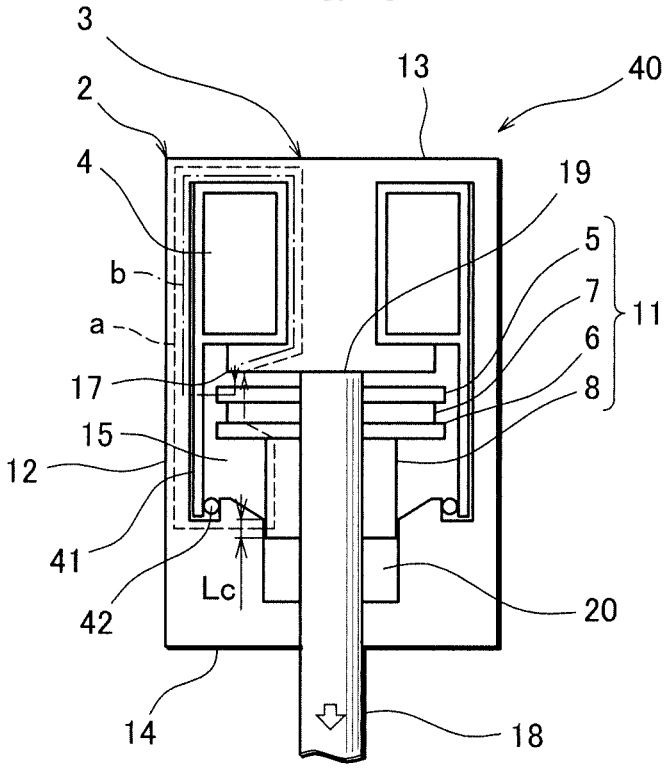
FIG. 9 is a longitudinal sectional view illustrating the electromagnetic actuator functioning in a latched position in the second embodiment.
Figure 10:
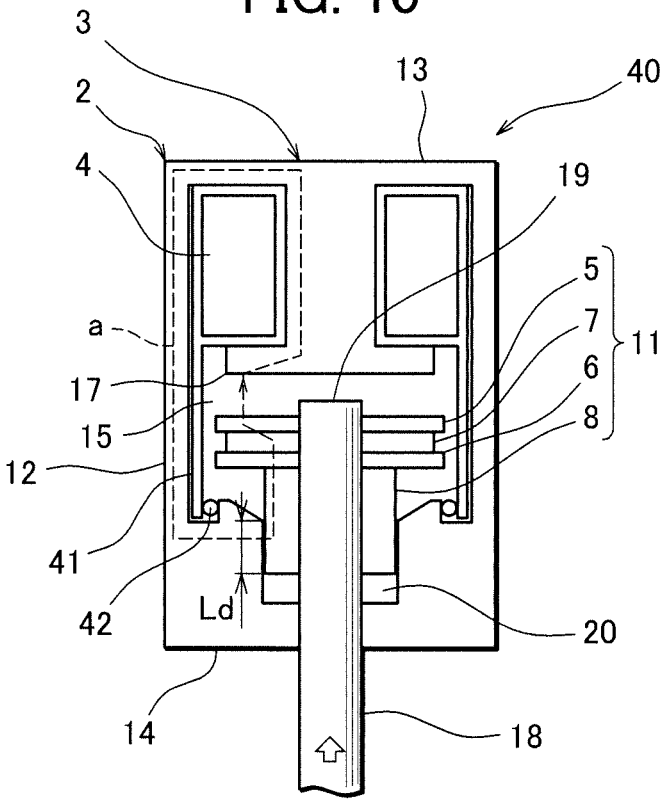
FIG. 10 is a longitudinal sectional view illustrating the electromagnetic actuator functioning in a stroke midway position in the second embodiment.

FIG. 7 is a longitudinal sectional view illustrating a structure of an electromagnetic actuator 40 in the second embodiment of the present invention. FIG. 8 is a transverse sectional view of the electromagnetic actuator 40 in the second embodiment, illustrating a cross section at a portion B-B illustrated in FIG. 7. FIGS. 9, 10 are longitudinal sectional views of the electromagnetic actuator 40 in the second embodiment, FIG. 9 illustrates the electromagnetic actuator 40 functioning in a latched position S0, and FIG. 10 illustrates the electromagnetic actuator 40 functioning in a stroke midway position S1.

As illustrated in FIGS. 7, 8, the electromagnetic actuator 40 in the second embodiment of the present invention differs from the electromagnetic actuator 1 in the first embodiment in that the electromagnetic actuator 40 includes a body 41 configured to enclose the internal space 15 in the yoke 2.

The body 41 is formed of non-magnetic material such as resin. The body 41 is disposed being inserted in the surrounding wall member 12 of the yoke 2 and formed to have a cylindrical shape with a bottom end portion opened. The body 41 is disposed so that at least the front end portion 17 of the stator core 3 and the mover 11 are covered with the body 41, and the bottom end portion is in intimate contact with the bottom wall member 14 of the yoke 2 with an O-ring 42 interposed therebetween along its overall circumference. The electromagnetic actuator 40 therefore has a structure in which the internal space 15 of the yoke 2 including the mover 11 and the front end portion 17 of the stator core 3 is enclosed by the body 41.

As illustrated in FIG. 8, the surrounding wall member 12 of the yoke 2 is not provided extending along an overall circumference and removed in two opposing portions, that is, upper and lower portions in FIG. 8, to have the same width as an outer diameter size of the body 41. As a result, in comparison with the electromagnetic actuator 1 including the surrounding wall member 12 of the yoke 2 provided along the overall circumference as in the first embodiment, a width size Lw of the electromagnetic actuator 40 is configured to be short in one of a front-back direction and a right-left direction.

As illustrated in FIGS. 9, 10, in the electromagnetic actuator 40 in the second embodiment, main lines of magnetic force a pass between the ring member 8 and the bottom wall member 14 of the yoke 2 as with the electromagnetic actuator 1 in the first embodiment.

As in the first embodiment, in a latched position S0 illustrated in FIG. 9, an overlap size Lc between the ring member 8 and the bottom wall member 14 of the yoke 2 in the axial direction is made small to reduce latching force exerted by the permanent magnet 7, whereas in a stroke midway position S1 illustrated in FIG. 10, an overlap size Ld between the ring member 8 and the bottom wall member 14 of the yoke 2 in the axial direction is made larger than the overlap size Lc in the latched position S0, so that attraction of the mover 11 by the magnetic force exerted by the permanent magnet 7 can be ensured.

In addition, in the second embodiment, the internal space 15 is enclosed by the provision of the body 41, so that the electromagnetic actuator 40 can be protected by preventing dust or moisture from entering the internal space 15. In case where oil or the like flows into the internal space 15, the enclosure can inhibit the oil or the like from flowing out of a solenoid. This dispenses with the provision of the surrounding wall member 12 of the yoke 2 along the overall circumference, and as illustrated in FIG. 8, the opposing two portions in total of the surrounding wall member 12 of the yoke 2 are deleted to allow the width size Lw in a radial direction of the electromagnetic actuator 40 to be shortened.

Since the body 41 is made of non-magnetic substance, a gap between the second plunger 6 and the body 41 can be made small, and this also allows a radial direction size of the body 41, in turn, the width size Lw of electromagnetic actuator 40 to be decreased.

By decreasing the width size Lw of the electromagnetic actuator 40 in such a manner, for example, in a case where a plurality of electromagnetic actuators 40 are disposed along a camshaft for each of intake valves and exhaust valves in a variable valve mechanism of an in-line internal combustion engine, the internal combustion engine can be reduced in size in a direction in which the electromagnetic actuators 40 are arranged, namely an axial direction of the camshaft by shortening distances between adjacent electromagnetic actuators 40.

In addition, when the body 41 is formed using a material having a low coefficient of friction such as resin, even if the first plunger 5 or the second plunger 6 comes into contact with the body 41 when the shaft 18 is inclined under a force, slide resistance can be suppressed to ensure the movement of the mover 11.

Next, an electromagnetic actuator 50 in a third embodiment of the present invention will be described with reference to FIG. 11.

Figure 11:
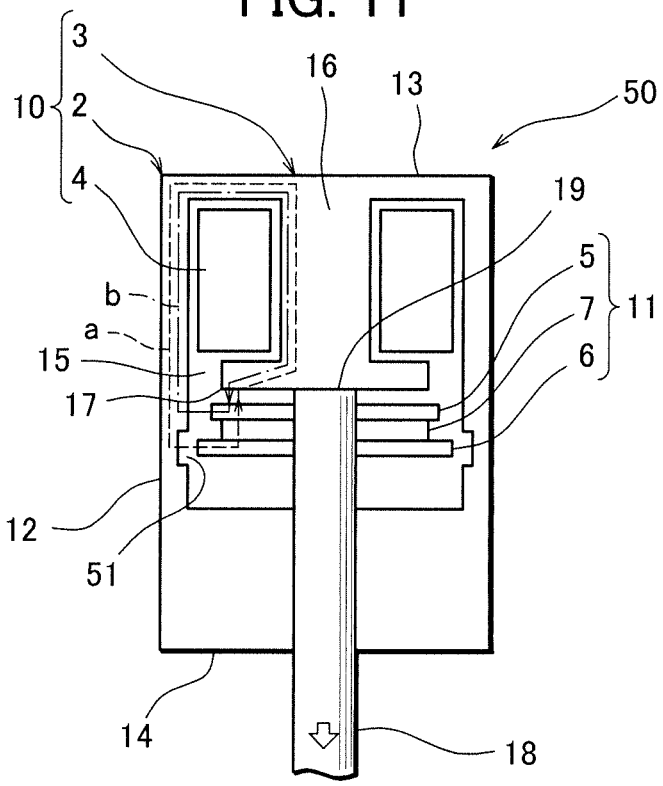
FIG. 11 is a longitudinal sectional view illustrating a structure of an electromagnetic actuator in a third embodiment of the present invention.

FIG. 11 is a longitudinal sectional view illustrating a structure of the electromagnetic actuator 50 in the third embodiment of the present invention, where the electromagnetic actuator 50 in a latched position S0 is illustrated.

As illustrated in FIG. 11, the electromagnetic actuator 50 in the third embodiment of the present invention differs from the electromagnetic actuator 30 in the above reference embodiment in that the electromagnetic actuator 50 includes a groove 51 on an inner circumferential surface of the surrounding wall member 12 of the yoke 2.

The groove 51 is formed by machining the surrounding wall member 12 of the yoke 2 to increase an inner diameter of the surrounding wall member 12 and is provided at a position facing an outer circumferential surface portion of the second plunger 6 in the latched position S0. The groove 51 of the surrounding wall member 12 corresponds to a magnetism transmission quantity adjusting portion according to the present invention.

This configuration increases a separation size between the outer circumferential surface portion of the second plunger 6 and the surrounding wall member 12 of the yoke 2 in the latched position S0, so that the magnetic force Fa from the permanent magnet 7 is weaker than in the electromagnetic actuator 30 in the reference embodiment. When the mover 11 moves from the latched position S0 in the separating direction, that is, when the stroke S increases, a distance between the outer circumferential surface portion of the second plunger 6 and the surrounding wall member 12 of the yoke 2 is shortened. This makes the magnetic force Fa from the permanent magnet 7 the same as that in the electromagnetic actuator 30 in the reference embodiment except for in a vicinity of the latched position S0. The magnetic force Fa from the permanent magnet 7 can therefore be made weaker than in the reference embodiment in the stroke midway position S1 while the magnetic force Fa from the permanent magnet 7 being the necessary attraction F1 or stronger is ensured in the latched position S0. The electromagnetic actuator 50 in the third embodiment can therefore be made into a highly responsive electromagnetic actuator with high responsiveness as in the electromagnetic actuator 1 in the first embodiment.

As to a shape of the groove 51 in the third embodiment, a depth of the groove 51 is not limited to a constant depth as illustrated in FIG. 11, and the depth of the groove 51 may be varied along the axial direction in a multilevel manner or continuous manner. By varying the depth of the groove 51 in such a manner, a distance between the outer circumferential surface of the second plunger 6 and the surrounding wall member 12 of the yoke 2 in the movement from the latched position S0 can be set at an arbitrary distance, which allows variations in the magnetic force Fa from the permanent magnet 7 to be set arbitrarily.

Next, an electromagnetic actuator 60 in a fourth embodiment of the present invention will be described with reference to FIG. 12.

Figure 12:
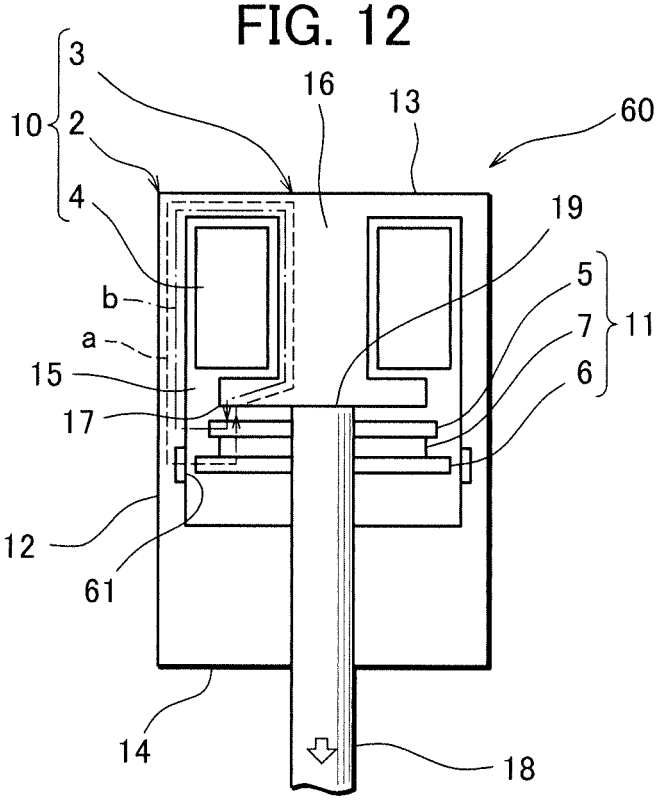
FIG. 12 is a longitudinal sectional view illustrating a structure of an electromagnetic actuator in a fourth embodiment of the present invention.

FIG. 12 is a longitudinal sectional view illustrating a structure of the electromagnetic actuator 60 in the fourth embodiment of the present invention, where the electromagnetic actuator 60 in a latched position S0 is illustrated.

As illustrated in FIG. 12, the electromagnetic actuator 60 in the fourth embodiment of the present invention includes not the groove 51 but a magnetic permeability reducing portion 61 in a region corresponding to a position of the groove 51 in the electromagnetic actuator 50 in the above third embodiment, the magnetic permeability reducing portion 61 reducing magnetic permeability of the region. The magnetic permeability reducing portion 61 may be formed by performing work hardening on the region of the surrounding wall member 12 through, for example, shotpeening to give the region a strain. The magnetic permeability reducing portion 61 corresponds to a magnetism transmission quantity adjusting portion according to the present invention.

By processing the surrounding wall member 12 of the yoke 2 in such a manner, the magnetic force Fa from the permanent magnet 7 can be reduced as in the third embodiment in the latched position S0.

A depth of magnetic permeability reducing portion 61 in the fourth embodiment is not limited, either, to a constant depth as illustrated in FIG. 12 and may be varied in a multilevel manner or continuous manner. By varying the depth of the magnetic permeability reducing portion 61, variations in the magnetic force Fa from the permanent magnet 7 in the movement from the latched position S0 can be set at arbitrary variations, as in the third embodiment.

The descriptions of the embodiments will be finished here, but aspects of the present invention are not limited to the above embodiments.

For example, the first embodiment or the second embodiment may have a structure in which the second plunger 6 and the ring member 8 are integrated. Additionally, minute structures of the electromagnetic actuators in the embodiments can be changed as appropriate. The electromagnetic actuator according to the present invention is also widely applicable to various uses other than electromagnetic valves.

What is claimed is:

1. An electromagnetic actuator, comprising:

a stator including a yoke with a housing space, a stator core provided in the housing space, and an electromagnetic coil disposed surrounding the stator core;

a mover including a permanent magnet and provided movably relative to the stator core in the housing space in an axial direction of the yoke, magnetic force from the permanent magnet causing the stator core and the mover to attract each other, and electromagnetic force generated by energizing the electromagnetic coil causing the mover to resist the magnetic force from the permanent magnet to move from the stator core in a separating direction; and a magnetism transmission quantity adjusting portion provided at a position through which lines of magnetic force from the permanent magnet pass and configured to increase a magnetism transmission quantity from the permanent magnet when the mover moves relative to the stator core in the separating direction, the magnetism transmission quantity adjusting portion is disposed at a different position from the electromagnetic coil in the axial direction of the yoke, and includes a columnar ring member provided in the mover and protruding in the axial direction, and an edge member of the yoke including a hole portion through which the ring member is inserted, the hole portion extending in the axial direction, wherein an inner circumferential surface of the hole portion is parallel to an outer circumferential surface of the ring member, an insertion distance of the ring member relative to the hole portion changes in accordance with a movement position of the mover, so that a passage cross-sectional area of lines of magnetic force from the permanent magnet between the ring member and the edge member changes, when the electromagnetic coil is not energized, the mover is located at a latched position having the edge member of the yoke and an outer circumferential surface of the ring member overlap parallel to the axial direction of the yoke and are adjacent to each other perpendicular to the axial direction of the yoke, and in the latched position of the mover, a region where the edge member of the yoke and the outer circumferential surface of the ring member are adjacent to each other and overlap parallel to the axial direction of the yoke and are adjacent to each other perpendicular to the axial direction of the yoke is a region which has a smallest cross-sectional area of regions through which the lines of magnetic force from the permanent magnet pass.

2. The electromagnetic actuator according to claim 1, wherein the mover includes a plunger disposed facing the stator core in the housing space of the yoke, and the ring member is formed to have a diameter smaller than a diameter of the plunger.

3. The electromagnetic actuator according to claim 1, wherein a cylindrical-shaped body is provided between a surrounding wall member of the yoke and the mover, the body enclosing the housing space of the yoke including the mover and formed of non-magnetic material, and the magnetism transmission quantity adjusting portion is disposed at a different position from the body in the axial direction of the yoke.

4. The electromagnetic actuator according to claim 2, wherein a cylindrical-shaped body is provided between a surrounding wall member of the yoke and the mover, the body enclosing the housing space of the yoke including the mover and formed of non-magnetic material, and the magnetism transmission quantity adjusting portion is disposed at a different position from the body in the axial direction of the yoke.

* * * * *